US005950795A

United States Patent [19]

Kojima

[11] Patent Number: 5,950,795

[45] Date of Patent: Sep. 14, 1999

[54] EXACT CHANGE COIN COLLECTION DEVICE

[75] Inventor: Kouya Kojima, Tokyo, Japan

[73] Assignees: Showa Yuen Kabushiki-Kaisha; Yuen -Gaisha Cherry Services, both of Japan

[21] Appl. No.: 08/967,854

[22] Filed: Nov. 12, 1997

[30] Foreign Application Priority Data

Nov. 12, 1996 [JP] Japan ..... 8-300079

[51] Int. Cl.[6] ..... G07F 5/00; G07F 1/04

[52] U.S. Cl. ..... 194/241; 194/346

[58] Field of Search ..... 194/346, 241, 194/242, 317; 379/149, 150, 151, 152, 153

[56] References Cited

U.S. PATENT DOCUMENTS

| | | | |
|---|---|---|---|
| 4,393,972 | 7/1983 | Maloy | 194/346 |
| 4,437,557 | 3/1984 | Kolbl et al. | 194/346 |
| 4,865,178 | 9/1989 | Lewandowski | 194/346 |
| 5,415,264 | 5/1995 | Menoud | 194/217 |
| 5,788,047 | 8/1998 | Chung | 194/346 |

*Primary Examiner*—Christopher P. Ellis
*Assistant Examiner*—Bryan Jaketic
*Attorney, Agent, or Firm*—Morrison Law Firm

[57] ABSTRACT

An exact change coin collection device has a coin holding chamber into which all coins collected are temporarily directed. A coin collection stopper releases coins from the coin holding chamber into a coin collection chamber when a preset monetary amount of genuine coins is inserted. A coin return stopper releases all coins from the coin holding chamber into a coin return when the value of coins collected exceeds the preset monetary amount; a counterfeit coin is inserted; or the time since the last coin was inserted exceeds a predetermined time. A setting mechanism permits setting the preset monetary amount.

4 Claims, 3 Drawing Sheets

EXACT CHANGE COIN COLLECTION DEVICE

BACKGROUND OF THE INVENTION

This invention relates to a coin collection device for attachment to various types of vending machines or coin-operated amusement devices, etc. and, in particular, it relates to an improvement in simple coin collection devices that lack a change-making mechanism.

The growing popularity of vending machines and ticket dispensing machines has been accompanied by the development of high-grade fee collection devices that can make change and accept high-value paper money. These devices have had to be large and expensive, because they need a large coin storage device to be preloaded with a large number of coins for change-making and because they need sophisticated sensors and computers to detect counterfeit paper money.

But such high-tech, large-size devices are not needed for collecting, for example, fees for small rides for children in amusement parks and elsewhere, fees for game machines, or fees for capsule vendors, which sell inexpensive toys or prizes inside small capsules. In such applications, where a fixed fee is collected in the form of coins, one needs only a simple coin collection device with no change-making function. There are many fields in which such a simple device suffices.

But simple coin collection devices with no change-making function have heretofore been unable to quickly and correctly handle such situations as when the user mistakenly puts in too much money or, in the midst of inserting coins, wishes to have inserted coins returned because he notices that he does not have the right coins for the remaining amount. Because such devices are often used by children, trouble has arisen.

Another inconvenience is that when the fee to be collected changes, such as with a change in the sales tax rate, one must call upon the manufacturer to replace the necessary parts.

To adapt the device to be able to promptly handle such eventualities, it has been necessary to make the device complicated, sophisticated, and large.

OBJECTS OF THE INVENTION

This invention was devised to solve the problems of the prior art. Its purpose is to provide a small coin collection device which, despite its relatively simple construction, is able to quickly and correctly handle misoperation or changes in the fee to be collected.

Briefly stated, the present invention provides a coin collection device that has a coin holding chamber into which all coins collected are temporarily directed. A coin collection stopper releases coins from the coin holding chamber into a coin collection chamber when a preset monetary amount of genuine coins is inserted. A coin return stopper releases all coins from the coin holding chamber into a coin return when at least one of the following events occurs:

the value of coins collected exceeds the preset monetary amount;

a counterfeit coin is inserted; or the time since last coin inserted exceeds a predetermined time;

A setting mechanism permits setting the preset monetary amount.

According to an embodiment of the invention, there is provided a coin collection device including a memory device and means for inputting to the memory device a set monetary amount. A sensor is used to determine whether a coin is good or false, and to determine a denomination of a good coin. The memory device accumulates the value of good coins. A coin holding chamber is used for temporarily storing inserted coins. A coin collection stopper leads to a coin container. A coin return stopper leads to a coin return. The coin collection stopper and the coin return stopper retain at least one good coin in the coin holding chamber. A stopper controller is used for opening the coin collection stopper in response to a sum of the values of good coins being equal to the set monetary amount, whereby good coins are collected. The stopper controller is also effective to open the coin return stopper in response to the sensor sensing a false coin, the sum of inserted coins is greater than the set monetary amount, or when too much time has passed between the insertion of one coin and the next. In any of those instances, all coins retained in the holding chamber are returned to a user.

According to a feature of the invention, there is provided a coin guidance tube being effective to guide an inserted coin from a coin insertion slot to a coin holding chamber. A coin collection slot and a coin return slot lead from said coin holding chamber. A coin collection stopper selectably closes said collection slot. A coin return stopper selectably closes said return slot. A coin sensor is disposed between said coin insertion slot said the coin holding chamber. The coin sensor has a means for determining whether an inserted coin is genuine or counterfeit and for determining a denomination of said inserted coin. A memory records an accumulated value of genuine coins that have passed to said coin holding chamber. A monetary amount setter is used for selecting, setting, and recording a set monetary amount to be collected. A stopper controller is used for opening said coin collection stopper when said set monetary amount is equal to said accumulated value. The stopper controller is further used for opening said coin return stopper when at least one of the following occurs: the total value exceeds the set monetary amount, a not-enough-money condition continues for a predetermined time, or a fake coin or inappropriate coin is inserted.

According to another feature of the invention a coin insertion slot communicates with a coin guidance member. A return slot communicates with the guidance member with a coin return stopper disposed therebetween. A collection slot also communicates with the guidance member with a coin collection stopper disposed therebetween. A coin sensor is used for determining the genuineness of an inserted coin and further for producing an accumulated value equal to the monetary value of the sum of inserted coins. A memory is used for storing and recalling a set monetary amount and for further storing and recalling said accumulated value. A setting means is used for setting a monetary amount to be stored in said memory. A stopper controller is used for controlling said coin collection stopper and said coin return stopper.

The above, and other objects, features and advantages of the present invention will become apparent from the following description read in conjunction with the accompanying drawings, in which like reference numerals designate the same elements.

DETAILED DESCRIPTION OF THE DRAWINGS

Figure 1:
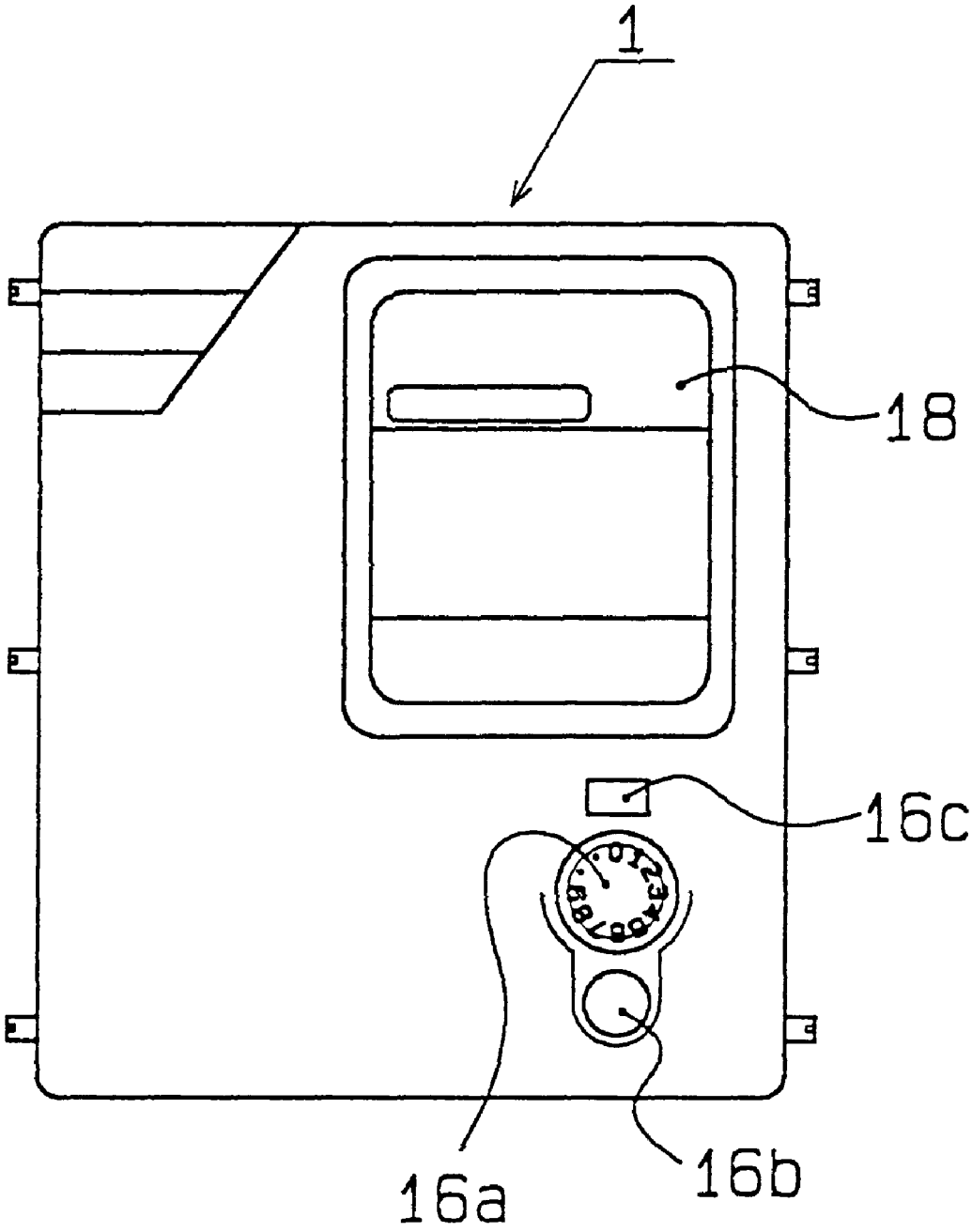
FIG. 1 is a front view of an embodiment of the coin collection device of this invention.
Figure 2:
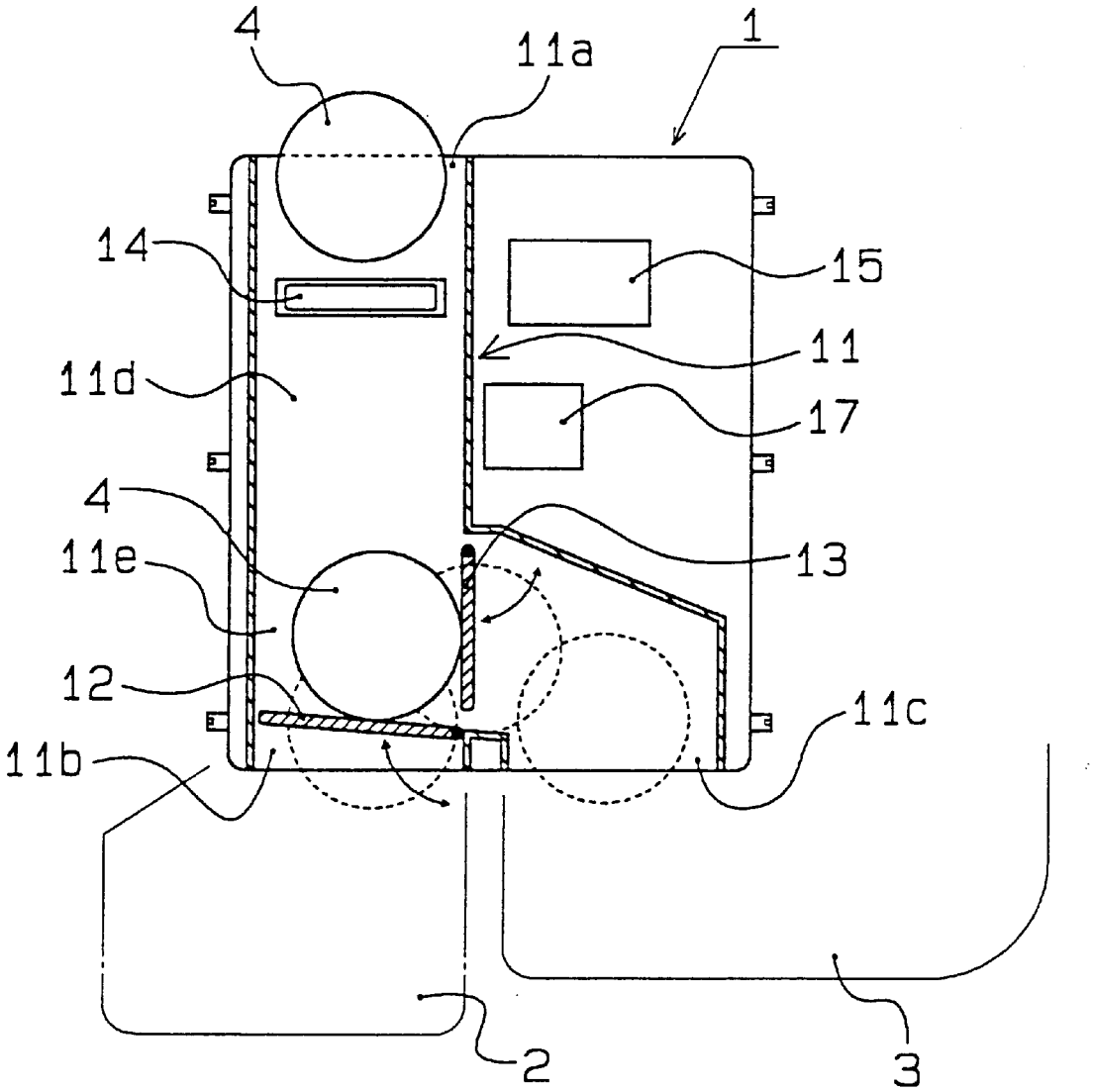
FIG. 2 is a front cross-sectional view of the essential parts of the coin collection device of FIG. 1.
Figure 3:
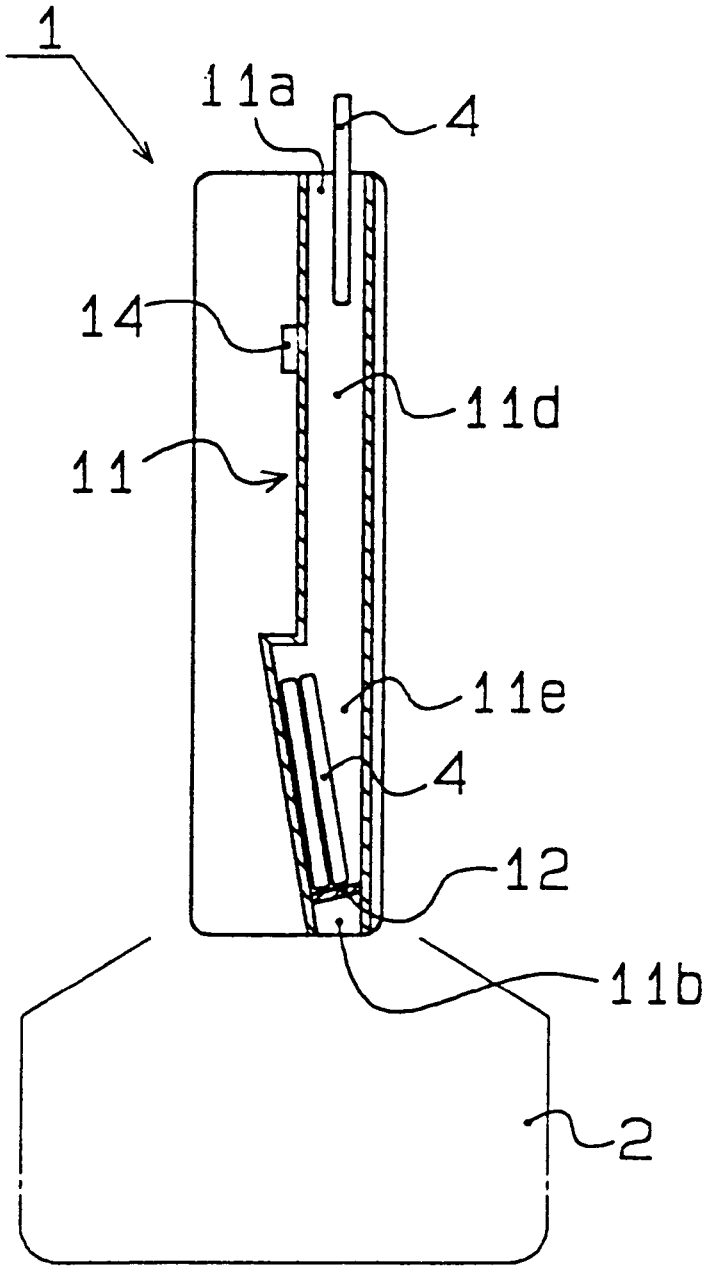
FIG. 3 is a left side cross-sectional view of the essential parts shown in FIG. 2.

Referring to FIG. 1, a coin collection device 1 includes a display window 18 that displays, for example, the set monetary amount or the total monetary amount thus far collected and held in coin container 2 (shown in FIGS. 2 and 3).

A monetary amount setter includes a dial 16*a* by which one selects a desired monetary amount. A button 16*b* permits setting and recording the amount. A cancel button 16*c* deletes the entries made up to the time of actuation. A memory, to be described later, records the set amount and other pertinent data.

Referring now to FIG. 2, coin collection device 1 includes a coin container 2 that holds and stores the coins that are collected by coin collection device 1. A return tray 3 passes returned coins 4, to the user.

A coin guidance tube 11 consists of a guidance channel 11*d*, which leads from a coin insertion slot 11*a* to a coin holding chamber 11*e*. A coin collection stopper 12 temporarily closes the bottom of guidance channel 11*d* leading to coin container 2. A coin return stopper 13 closes the side of guidance channel 11*d* leading to return slot 11*c* and return tray 3. After residing temporarily in coin holding chamber 11*e*, a coin 4 passes either to a collection slot 11*b* or a return slot 11*c*, depending on the nature of the coin or the transaction.

A coin sensor 14 distinguishes whether the coin passing through coin guidance channel 11*d* is real money or a slug and judges its denomination. Coin sensor 14 may use any convenient conventional technology to distinguish good coins from false coins. For example, coin sensor 14 may use deviations in weight, magnetic properties, electrical conduction properties, or combinations of the above, and other properties, from the characteristics of good coins to decide whether a coin is good or false. Such detection capabilities are well known to those skilled in the art, and thus further detail thereof is omitted.

A memory 15 records the total value of good coins inserted thus far, using the number of good coins times their denominations detected by coin sensor 14.

A stopper controller 17 controls the opening and closing of coin collection stopper 12 and coin return stopper 13. Stopper controller 17 may include conventional solenoid and other electromechanical elements (not shown) for performing the opening and closing operations. Stopper controller 17 also includes an electronic circuit that emits operation signals based on data from memory 15.

In use, coin collection stopper 12 and coin return stopper 13 are originally closed, as shown in FIG. 2. Assume that the set monetary amount to be collected is 110 yen. When the user first inserts a 100 yen through coin insertion slot 11*a*, coin sensor 4 determines whether it is genuine or counterfeit, determines its denomination and, if the coin is genuine, this value is recorded in memory 15. The coin passes into coin holding chamber 11*e*, where it is held temporarily. If the inserted coin is not genuine, coin return stopper 13 immediately opens, and the fake coin is ejected into return tray 3.

If the 100-yen coin genuine and if 10-yen coin is inserted within a fixed time, its genuineness and denomination are determined as above. If the 10-yen coin is genuine, since the total amount agrees with the set amount of 110 yen, stopper controller 17 opens coin collection stopper 12. The 100 yen coin held in coin holding chamber 11*e* and the next-inserted 10 yen coin fall through collection slot 11*b* into coin container 2 and are collected.

If the 10 yen coin is bogus, or if the second coin inserted brings the total amount inserted to a value exceeding 110 yen, stopper controller 17 opens coin return stopper 13. The 100 yen coin held in coin holding chamber 11*e* and the newly inserted coin are both ejected through return slot 11*c* into return tray 3. All coins in the holding chamber are returned under the following conditions:

(1) if the next-inserted coin is a 50 yen or 100 yen coin and the total amount together with the first-inserted 100 yen exceeds the set amount of 110 yen, or (2) if, after the original 100 yen coin is inserted, a 10 yen coin is not inserted within a predetermined time, or (3) a next-inserted coin is not genuine, or (4) the first-inserted coin is not genuine.

In relation with the performance of coin sensor 14, if only 100 yen and 10 yen coins can be recognized and other coins such as 50, 5, and 1 yen coins cannot be distinguished, they may all be treated as unsuitable coins. When such unsuitable coins are inserted, coin return stopper 13 is opened to return them in the same way as fake coins.

If the set amount to be collected requires three or more coins, such as 120 yen or 210 yen, the inserted coins are temporarily held in coin holding chamber 11*e* until the inserted amount reaches the set amount.

The sequence in which the coin denominations are inserted does not matter. That is, if the set amount is, for example, 120 yen, coins may be inserted in the order 100 yen→10 yen→10 yen, or in the order 10 yen→100 yen→10 yen, or in the order 10 yen→10 yen→100 yen.

Taking all this into account, the opening and closing of coin collection stopper 12 and coin return stopper 13 is as follows. When the total amount judged by coin sensor and sequentially recorded in memory 15 agrees with the preset amount to be collected, coin collection stopper 12 opens; otherwise—that is, when the set amount is exceeded, or when the not-enough-money condition continues for a certain length of time, or when a fake or inappropriate coin is inserted—coin return stopper 13 opens to return all coins to the user.

Since a change in the set amount to be collected can easily be made with the monetary amount setter 16*a*–16*c*, the troublesome operation of replacing parts is eliminated.

This invention has a small-size coin collection device that, despite its relatively simple construction, can quickly and correctly handle misoperation, needs no large coin storage device, and can easily handle changes in the amount of the fee to be collected in response to such things as changes in the sales tax rate.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A coin collection device comprising:

a sensor having means effective to determine whether a coin is fake, and means for determining a value of a good coin;

a memory device having means for determining an accumulated value of inserted good coins;

a predetermined set monetary amount;

a coin holding chamber having means for temporarily storing inserted coins;

a coin collection stopper leading to a coin container;

a coin return stopper leading to a coin return;

said coin collection stopper and said coin return stopper having means effective to retain at least one good coin in said coin holding chamber;

a stopper controller;

said stopper controller having means effective to open said coin collection stopper when said accumulated value of said good coins is equal to said set monetary amount, whereby said good coins are collected; and said stopper controller further having means effective to open said coin return stopper in the event of at least one of said sensor sensing a false coin, said accumulated value exceeds said set monetary amount, and a temporal period from insertion of a last coin exceeds a predetermined temporal period when said accumulated value is less than said set monetary amount, whereby any coins being held in said coin holding chamber are returned to a user.

2. Apparatus according to claim 1, further comprising:

a monetary amount setting means;

said monetary amount setting means including controls permitting setting of said set monetary amount.

3. A coin collection device comprising:

a coin guidance tube being effective to guide an inserted coin from a coin insertion slot to a coin holding chamber;

a coin collection slot leading from said coin holding chamber;

a coin return slot leading from said coin holding chamber;

a coin collection stopper selectably closing said collection slot;

a coin return stopper selectably closing said return slot;

a coin sensor disposed between said coin insertion slot said the coin holding chamber;

said coin sensor including means for determining whether an inserted coin is genuine or counterfeit and further having means for determining a monetary value of said inserted coin;

a memory having means effective to record an accumulated value of genuine coins that have passed to said coin holding chamber;

a monetary amount setter having means for selecting, setting, and recording a set monetary amount to be collected; and a stopper controller;

said stopper controller including means for opening said coin collection stopper when said set monetary amount is equal to said accumulated value;

said stopper controller further including means for opening said coin return stopper upon an occurrence of at least one of said accumulated value exceeds said set monetary amount, a not-enough-money condition continues for a predetermined time, and a fake coin or inappropriate coin is inserted.

4. A coin collection device comprising:

a coin insertion slot communicating with a coin guidance member;

a return slot communicating with said guidance member with a coin return stopper therebetween;

a collection slot communicating with said guidance member with a coin collection stopper therebetween;

a coin sensor having means for determining the genuineness of an inserted coin and further having means for producing an accumulated value equal to a monetary value of a sum of inserted genuine coins;

a memory having means for storing and recalling a set monetary amount and further having means for storing and recalling said accumulated value;

means for setting said set monetary amount to be stored in said memory;

a stopper controller having means for controlling said coin collection stopper and said coin return stopper;

said stopper controller is programmed to open said coin collection stopper when said accumulated value is equal to said set monetary amount; and said stopper controller is further programmed to open said coin return stopper in the event of at least one of said accumulated value exceeds said set monetary amount, a temporal period after an insertion of a last coin exceeds a preset temporal period and a counterfeit coin is detected by said coin sensor.

* * * * *